US012790733B2

(12) United States Patent
Lee et al.

(10) Patent No.: US 12,790,733 B2
(45) Date of Patent: Nov. 10, 2026

(54) WASHING MACHINE AND CONTROLLING METHOD FOR WASHING MACHINE

(71) Applicant: SAMSUNG ELECTRONICS CO., LTD., Suwon-si (KR)

(72) Inventors: Sungmo Lee, Suwon-si (KR); Junhyun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 205 days.

(21) Appl. No.: 18/323,994

(22) Filed: May 25, 2023

(65) Prior Publication Data

US 2023/0295855 A1 Sep. 21, 2023

Related U.S. Application Data

(63) Continuation of application No. PCT/KR2022/000591, filed on Jan. 12, 2022.

(30) Foreign Application Priority Data

Jan. 15, 2021 (KR) ..... 10-2021-0005674

(51) Int. Cl.

| | |
|---|---|
| ***D06F 34/18*** | (2020.01) |
| ***D06F 33/48*** | (2020.01) |
| ***D06F 103/04*** | (2020.01) |
| ***D06F 103/24*** | (2020.01) |

(52) U.S. Cl.

CPC ..... *D06F 34/18* (2020.02); *D06F 33/48* (2020.02); *D06F 2103/04* (2020.02); *D06F 2103/24* (2020.02)

(58) Field of Classification Search

CPC ..... D06F 33/40; D06F 33/60; D06F 34/18; D06F 2105/18

See application file for complete search history.

(56) References Cited

U.S. PATENT DOCUMENTS

| | | | |
|---|---|---|---|
| 7,676,874 | B2 | 3/2010 | Cho |
| 8,302,232 | B2 | 11/2012 | Bae et al. |
| 8,341,787 | B2 | 1/2013 | Kim et al. |

(Continued)

FOREIGN PATENT DOCUMENTS

| | | | |
|---|---|---|---|
| JP | 5650927 | B2 | 1/2015 |
| KR | 10-2005-0038793 | A | 4/2005 |

(Continued)

OTHER PUBLICATIONS

KR20140145223A Machine Translation (Year: 2014).*

(Continued)

*Primary Examiner* — Spencer E. Bell

(57) ABSTRACT

A washing machine capable of reducing motor noise during a spin-drying cycle includes: a rotating tub for accommodating laundry; a motor connected to the rotating tub; a driving circuit for supplying driving current to the motor to rotate the motor; a sensor for outputting sensing values that vary according to a weight of the laundry; and a control unit for controlling the driving circuit to decelerate the motor when the speed of the motor reaches a target rotation speed during the spin-drying cycle, wherein the motor is decelerated at a target rotational deceleration rate determined on the basis of the weight of the laundry.

6 Claims, 14 Drawing Sheets

(56) References Cited

U.S. PATENT DOCUMENTS

| | | | | |
|---|---|---|---|---|
| 9,528,212 | B2 | 12/2016 | Lee et al. | |
| 11,180,883 | B2 | 11/2021 | Kim et al. | |
| 11,352,728 | B2 | 6/2022 | Lee et al. | |
| 2004/0194226 | A1 | 10/2004 | Kim et al. | |
| 2007/0050918 | A1 | 3/2007 | Kim et al. | |
| 2010/0031451 | A1* | 2/2010 | Bae | D06F 34/18 68/12.02 |
| 2014/0115792 | A1* | 5/2014 | Lee | D06F 33/32 68/12.06 |
| 2016/0222574 | A1* | 8/2016 | Bae | D06F 33/40 |
| 2017/0233926 | A1* | 8/2017 | Jung | H02P 6/08 68/12.16 |

FOREIGN PATENT DOCUMENTS

| | | | | |
|---|---|---|---|---|
| KR | 10-0480707 | B1 | 4/2005 | |
| KR | 10-2007-0025790 | A | 3/2007 | |
| KR | 10-0792237 | B1 | 1/2008 | |
| KR | 10-0928254 | B1 | 11/2009 | |
| KR | 10-0934652 | B1 | 12/2009 | |
| KR | 20100094878 | A | 8/2010 | |
| KR | 10-1028089 | B1 | 4/2011 | |
| KR | 10-1210994 | B1 | 12/2012 | |
| KR | 10-1241891 | B1 | 3/2013 | |
| KR | 10-2014-0055262 | A | 5/2014 | |
| KR | 10-1407959 | B1 | 6/2014 | |
| KR | 20140145223 | A * | 12/2014 | D06F 33/40 |
| KR | 10-2018-0074375 | A | 7/2018 | |
| KR | 10-1980854 | B1 | 5/2019 | |
| KR | 10-2020-0065406 | A | 6/2020 | |
| KR | 10-2521856 | B1 | 4/2023 | |

OTHER PUBLICATIONS

International Search Report and Written Opinion of the International Searching Authority dated Apr. 27, 2022, in connection with International Application No. PCT/KR2022/000591, 11 pages.

Office Action issued Feb. 20, 2026, in connection with Korean Patent Application No. 10-2021-0005674, 14 pages.

* cited by examiner

FIG. 10

| LOAD | DECELERATION METHOD | | DECELERATION TIME [sec] |
|---|---|---|---|
| NO LOAD | Short Brake | | 5 |
| | DECELERATION CONTROL [rpm/sec] | 10 | 26 |
| | | 20 | 13 |
| | | 30 | HIGH VOLTAGE |
| WEIGHT 14kg | Short Brake | | 19 |
| | DECELERATION CONTROL [rpm/sec] | 3 | 87 |
| | | 5 | 52 |
| | | 7 | HIGH VOLTAGE |

WASHING MACHINE AND CONTROLLING METHOD FOR WASHING MACHINE

CROSS-REFERENCE TO RELATED APPLICATIONS

This application is a bypass continuation of International Application No. PCT/KR2022/000591, filed Jan. 12, 2022, which claims priority to Korean Patent Application No. 10-2021-0005674, filed Jan. 15, 2021, the disclosures of which are herein incorporated by reference in their entirety.

BACKGROUND

1. Field

The disclosure relates to a washing machine and controlling method for the washing machine, and more particularly, to a washing machine and controlling method for the washing machine for reducing noise occurring in a spin-drying course.

2. Description of Related Art

In general, a washing machine may include a tub and a rotating tub rotationally installed in the tub and do the laundry by rotating the rotating tub containing clothes inside the tub. The washing machine may perform a washing course for washing the clothes, a rinsing course for rinsing the washed clothes, and a spin-drying course for dehydrating the clothes.

The spin-drying course in particular may separate water absorbed in the clothes contained in the rotating tub from the clothes by accelerating the rotating tub at high speed and decelerating the rotating tub.

In the case of decelerating the rotating tub, a short braking method is used to prevent high voltage generation in an inverter.

The short braking method refers to a method by which a motor resistor consumes energy generated by a motor by turning off all three upper switching circuits and turning on all three lower switching circuits among six switching circuits.

In the case of having the motor resistor consume the energy generated by the motor, however, a lot of current flows to the motor, causing noise.

SUMMARY

The disclosure provides a washing machine and controlling method for the washing machine, by which motor noise may be reduced by decelerating the motor using deceleration control during a spin-drying course without using a short braking method.

According to an aspect of the disclosure, a washing machine includes a rotating tub containing laundry; a motor connected to the rotating tub; a driving circuit configured to apply a driving current to the motor to rotate the motor; a sensor configured to output a sensing value varying by a weight of the laundry; and a controller configured to control the driving circuit to decelerate the motor according to a target decelerating rotation speed determined based on the weight of the laundry in response to the motor reaching a target rotation speed in a spin-drying course.

The controller may control the driving circuit to rotate the motor at a final rotation speed higher than the target rotation speed for a preset period of time after the motor decelerates according to the target decelerating rotation speed.

The controller may control the driving circuit to decelerate the motor in a short braking method in response to the motor reaching the final rotation speed.

The controller may control the driving circuit to apply a negative current to the motor for decelerating the motor according to the target decelerating rotation speed.

The final rotation speed may be in a range from 2 to 2.5 times the target rotation speed.

The controller may determine the target decelerating rotation speed based on an inverse relationship with the weight of the laundry.

The sensor may include one of a first sensor configured to output a value of a current applied to the motor, a second sensor configured to output a value of a voltage applied to the motor, and a third sensor configured to output a value of power applied to the motor.

The controller may determine the weight of the laundry based on a sensing value output from the sensor in response to the motor reaching a preset rotation speed lower than the target rotation speed.

The controller may control the driving circuit to decelerate the motor according to the target decelerating rotation speed in response to activation of a noise reduction mode.

The controller may control the driving circuit to decelerate the motor in a short braking method in response to a deactivation of the noise reduction mode based on the motor reaching the target rotation speed.

According to an aspect of the disclosure, a controlling method for a washing machine including a rotating tub receiving laundry, a motor connected to the rotating tub, a driving circuit for applying a driving current to the motor to rotate the motor, and a sensor for outputting a sensing value varying by the weight of the laundry, includes, during a spin-drying course, determining weight of the laundry; determining a target decelerating rotation speed based on the weight of the laundry; and controlling the driving circuit to decelerate the motor according to the target decelerating rotation speed in response to the motor reaching a target rotation speed.

The controlling method may further include controlling the driving circuit to rotate the motor at a final rotation speed higher than the target rotation speed for a preset period of time after the motor decelerates according to the target decelerating rotation speed.

The controlling method may further include controlling the driving circuit to decelerate the motor in a short braking method in response to the motor reaching the final rotation speed.

The controlling of the driving circuit to decelerate the motor according to the target decelerating rotation speed may include controlling the driving circuit to apply a negative current to the motor for decelerating the motor according to the target decelerating rotation speed.

The determining of the target decelerating rotation speed based on the weight of the clothes may include determining the target decelerating rotation speed based on an inverse relationship with the weight of the clothes.

The determining of the weight of the clothes may include determining the weight of the laundry based on a sensing value output from the sensor in response to the motor reaching a preset rotation speed lower than the target rotation speed.

The controlling of the driving circuit to decelerate the motor according to the target decelerating rotation speed in response to the motor reaching the target rotation speed may be performed in response to activation of a noise reduction mode.

The controlling method may further include controlling the driving circuit to decelerate the motor in a short braking method in response to deactivation of the noise reduction mode based on the motor reaching the target rotation speed.

According to another aspect of the disclosure, a washing machine includes a rotating tub configured to receive laundry; a motor connected to the rotating tub; a driving circuit including an inverter comprised of a plurality of upper switching circuits and a plurality of lower switching circuits, and the driving circuit is configured to apply a driving current to the motor to rotate the motor; a sensor configured to output a sensing value varying by weight of the laundry; and a controller configured to accelerate the motor to a first rotation speed and then decelerate the motor to a second rotation speed in a spin-drying course, accelerate the motor to a third rotation speed after decelerating the motor to the second rotation speed, and control the driving circuit to decelerate the motor to a fourth rotation speed after accelerating the motor to the third rotation speed, wherein the first rotation speed is lower than the third rotation speed and the second rotation speed is higher than the fourth rotation speed, and wherein the controller is further configured to control the driving circuit to decelerate the motor according to a target decelerating rotation speed determined based on weight of the laundry in a first deceleration section for decelerating the motor from the first rotation speed to the second rotation speed, and control the driving circuit to decelerate the motor by turning off all the plurality of upper switching circuits and turning on all the plurality of lower switching circuits in a second deceleration section for decelerating the motor from the third rotation speed to the fourth rotation speed.

The controller may control the driving circuit to decelerate the motor according to the target decelerating target speed by applying a negative current to the motor in the first deceleration section.

According to the disclosure, motor noise occurring in a spin-drying course may be suppressed.

Furthermore, damage to an inverter circuit may be prevented by decelerating a motor at suitable decelerating speed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 10 illustrates deceleration time and whether high voltage is generated by an inverter in different deceleration methods.

DETAILED DESCRIPTION

Figure 1:
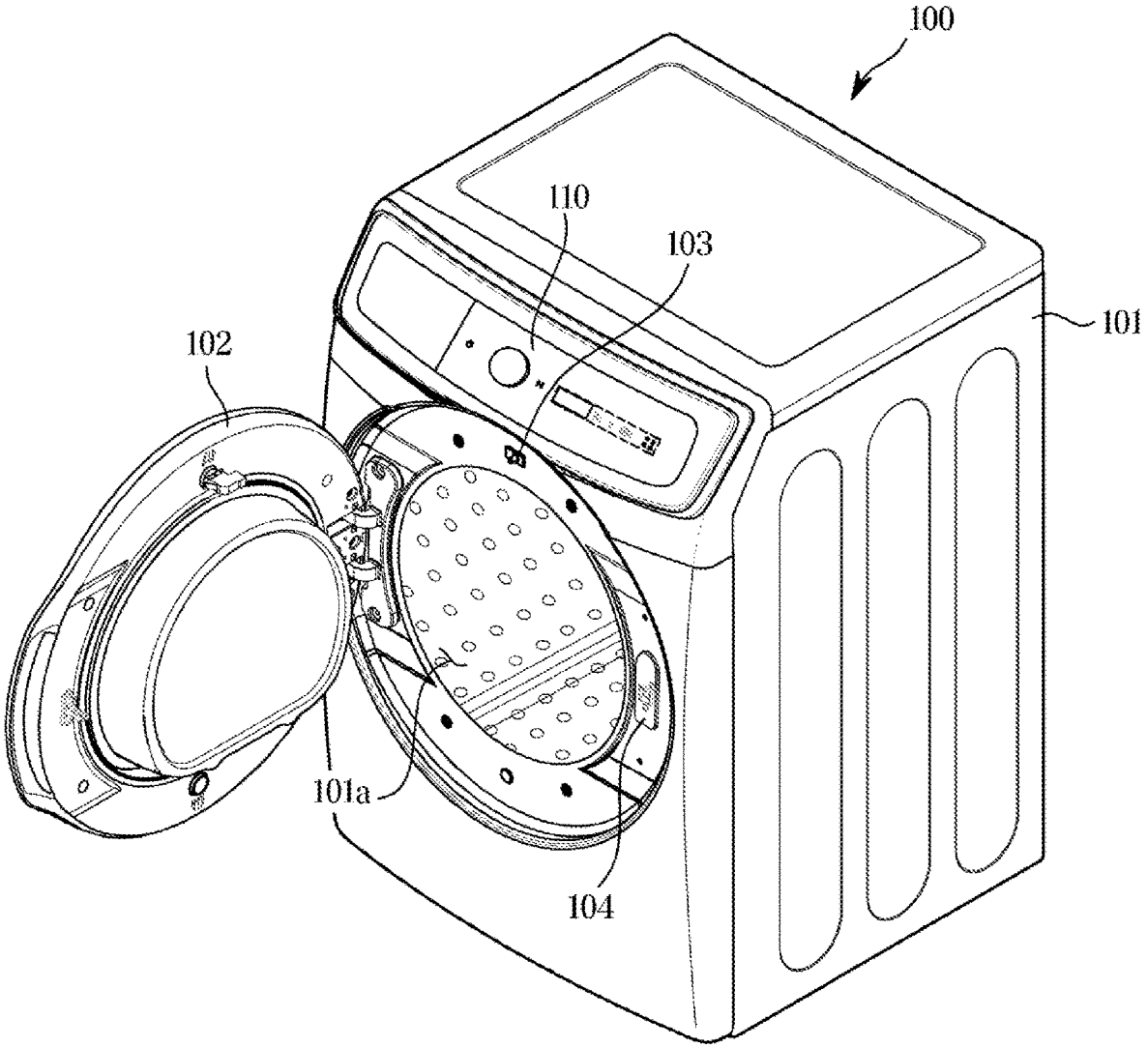
FIG. 1 is an exterior view of a washing machine, according to an embodiment.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments and features as described and illustrated in the disclosure are merely examples, and there may be various modifications replacing the embodiments and drawings at the time of filing this application.

The terminology used herein is for the purpose of describing particular embodiments only and is not intended to limit the disclosure.

For example, the singular forms "a", "an" and "the" as herein used are intended to include the plural forms as well, unless the context clearly indicates otherwise.

The terms "comprises" and/or "comprising," when used in this specification, represent the presence of stated features, integers, steps, operations, elements, components or combinations thereof, but do not preclude the presence or addition of one or more other features, integers, steps, operations, elements, components, or combinations thereof.

The term including an ordinal number such as "first", "second", or the like is used to distinguish one component from another and does not restrict the former component.

Furthermore, the terms, such as "~part", "~block", "~member", "~module", etc., may refer to a unit of handling at least one function or operation. For example, the terms may refer to at least one process handled by hardware such as a field-programmable gate array (FPGA)/application specific integrated circuit (ASIC), etc., software stored in a memory, or at least one processor.

An embodiment of the disclosure will now be described in detail with reference to accompanying drawings. Throughout the drawings, like reference numerals or symbols refer to like parts or components.

The working principle and embodiments of the disclosure will now be described with reference to accompanying drawings.

Figure 2:
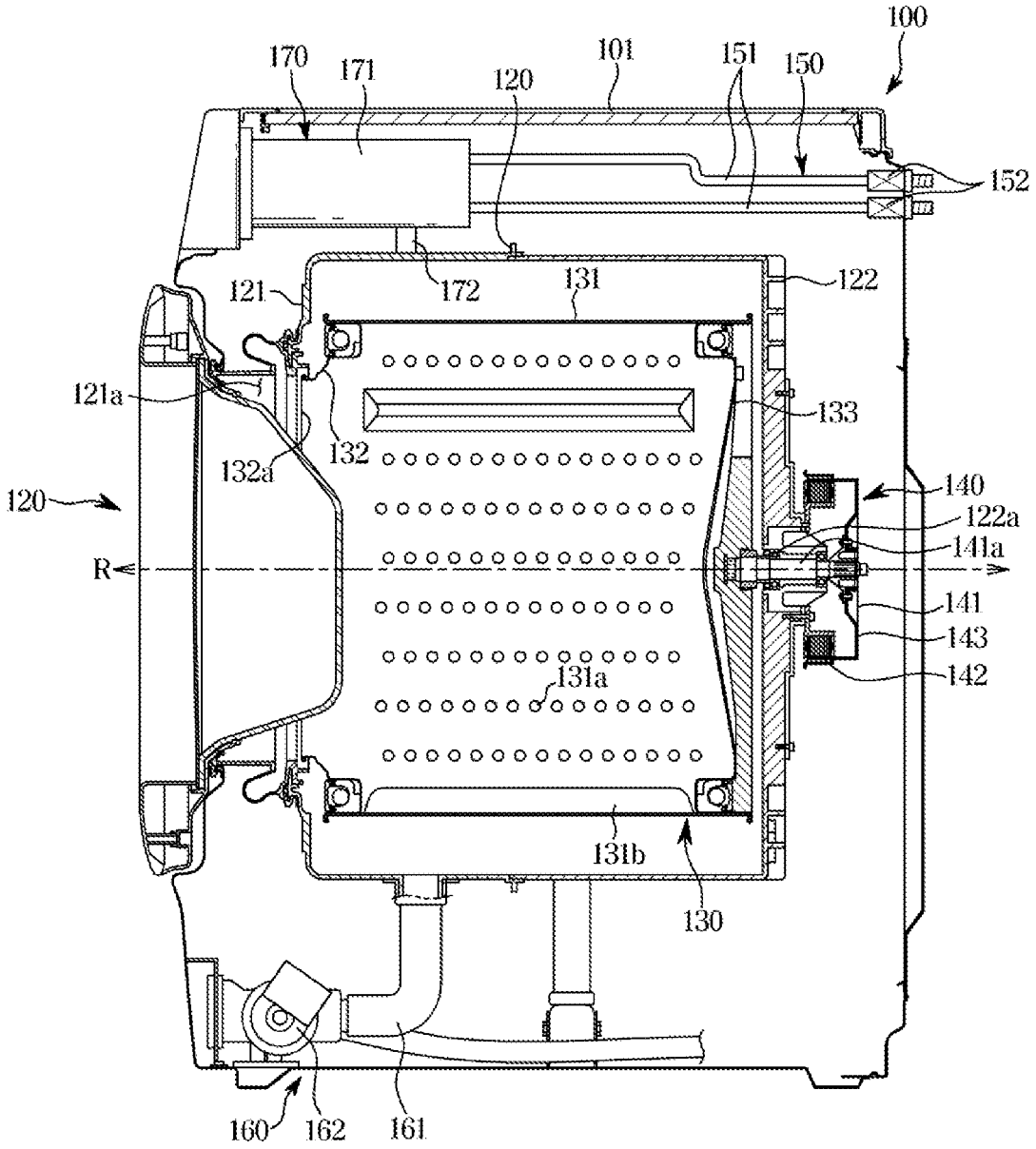
FIG. 2 is a side cross-sectional view of a washing machine, according to an embodiment.

FIG. 1 is an exterior view of a washing machine, according to an embodiment of the disclosure, and FIG. 2 is a side cross-sectional view of a washing machine, according to an embodiment of the disclosure.

Referring to FIGS. 1 and 2, described is a configuration of a washing machine 100.

The washing machine 100 may be a drum-type washing machine that does the laundry by rotating a rotating tub 130 to repeat rising and falling of the laundry, or an electric washing machine that does the laundry with water flows produced by a pulsator when the rotating tub 130 is rotated. In the following description, assume that the washing machine 100 according to the embodiment of the disclosure is the drum-type washing machine.

Referring to FIGS. 1 and 2, the washing machine 100 may include a cabinet 101. The washing machine 100 may further include a door 102, a control panel 110, a tub 120, the rotating tub (hereinafter, a drum) 130, a driver 140, a water supplier 150, a drain 160, and a detergent supplier 170 contained in the cabinet 101.

An inlet 101*a* may be formed in the middle of the front side of the cabinet 101 to draw in or out the laundry (or also referred to as clothes).

The door 102 may be arranged at the inlet 101*a*. The door 102 may be mounted on the cabinet 101 to pivot on a hinge.

The door 102 may open or close the inlet 101*a*, and that the inlet 101*a* is closed by the door 102 may be detected by a door switch 103. When the inlet 101*a* is closed and the washing machine 100 operates, the door 102 may be locked by a door lock 104.

The control panel 110 including a user input module for obtaining a user input for the washing machine 100 from the user and a display for displaying operation information of the washing machine 100 is arranged on an upper front portion of the cabinet 101. The control panel 110 will now be described later in more detail.

The tub 120 may be arranged inside the cabinet 101 and may contain water for washing and/or rinsing.

The tub 120 includes tub front parts 121 with an opening 121*a* formed on the front and tub rear parts 122 in the shape of a cylinder with a closed rear side.

The opening 121*a* through which to draw in or out clothes to or from the drum 130 arranged in the tub 120 is formed on the front of the tub front parts 121. A bearing 122*a* is arranged on the rear wall of the tub rear parts 122 to rotationally fix a motor 141.

The drum 130 may be rotationally arranged in the tub 120 and may contain the clothes to be washed.

The drum 130 may include a cylindrical drum body 131, drum front parts 132 arranged on the front of the drum body 131 and drum rear parts 133 arranged on the back of the drum body 131.

On the inner surface of the drum body 131, through holes 131*a* are formed connecting the inside of the drum 130 to the inside of the tub 120 and a lifter 131*b* is formed for lifting the clothes up the drum 130 during rotation of the drum 130. An opening 132*a* through which to draw in or out clothes to or from the drum 130 is formed on the drum front parts 132.

The drum rear parts 133 may be connected to a shaft 141*a* of the motor 141 that rotates the drum 130.

The driver 140 may include the motor 141 for rotating the drum 130.

The motor 141 is arranged on the outside of the tub rear parts 122 of the tub 120 and connected to the drum rear parts 133 of the drum 130 through the shaft 141*a*. The shaft 141*a* penetrates the tub rear parts 122 and is rotationally supported by the bearing 122*a* arranged on the tub rear parts 122.

The motor 141 includes a stator 142 fixed on the outside of the tub rear parts 122 and a rotor 143 rotationally arranged and connected to the shaft 141*a*. The rotor 143 may be rotated by magnetic interaction with the stator 142, and the rotation of the rotor 143 may be delivered to the drum 130 through the shaft 141*a*.

The motor 141 may include, for example, a brushless direct current motor (BLDC motor) or a permanent synchronous motor (PMSM) capable of easily controlling the rotation speed.

The water supplier 150 may supply water to the tub 120/drum 130.

The water supplier 150 may include a water supply conduit 151 connected to an external water source to supply water to the tub 120, and a water supply valve 152 arranged at the water supply conduit 151.

The water supply conduit 151 may be arranged above the tub 120 and may extend to a detergent container 171 from the external water source. The water may be guided to the tub 120 via the detergent container 171.

The water supply valve 152 may allow or block the supply of water to the tub 120 from the external water source in response to an electric signal. The water supply valve 152 may include, for example, a solenoid valve that is opened or closed in response to an electric signal.

The drain 160 may drain out the water stored in the tub 120 and/or the drum 130.

The drain 160 includes a drain conduit 161 arranged under the tub 120 to extend from the tub 120 to the outside of the cabinet 101, and a drain pump 162 arranged at the drain conduit 161. The drain pump 162 may pump the water in the drain conduit 161 to the outside.

The detergent supplier 170 may supply a detergent to the tub 120/drum 130.

The detergent supplier 170 may be arranged above the tub 120 and may include the detergent container 171 and a mixing conduit 172 that connects the detergent container 171 to the tub 120.

The detergent container 171 may be connected to the water supply conduit 151, and the water supplied through the water supply conduit 151 may be mixed with the detergent in the detergent container 171. The mixture of the detergent and the water may be supplied to the tub 120 through the mixing conduit 172.

Figure 3:
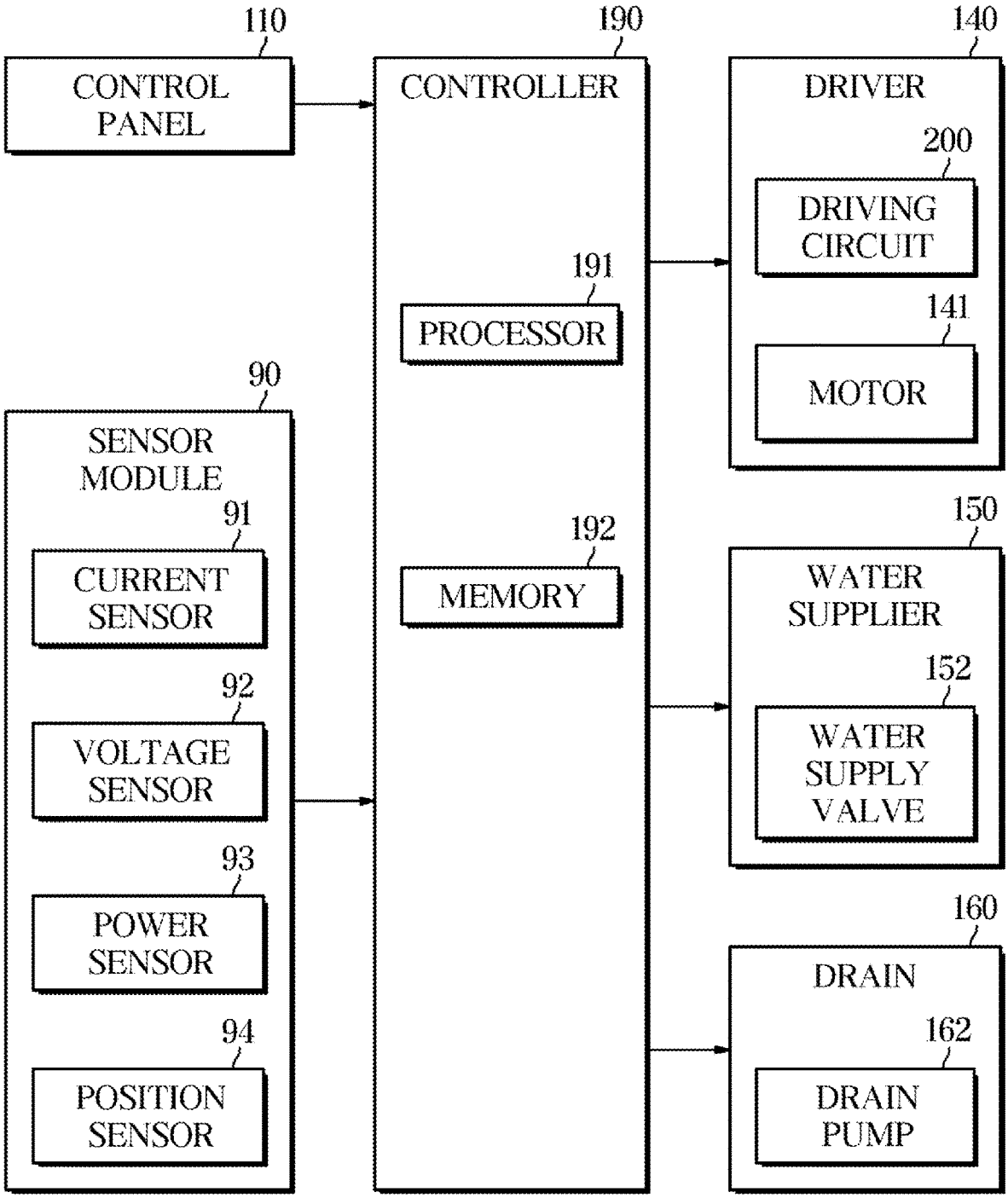
FIG. 3 is a control block diagram of a washing machine, according to an embodiment.
Figure 4:
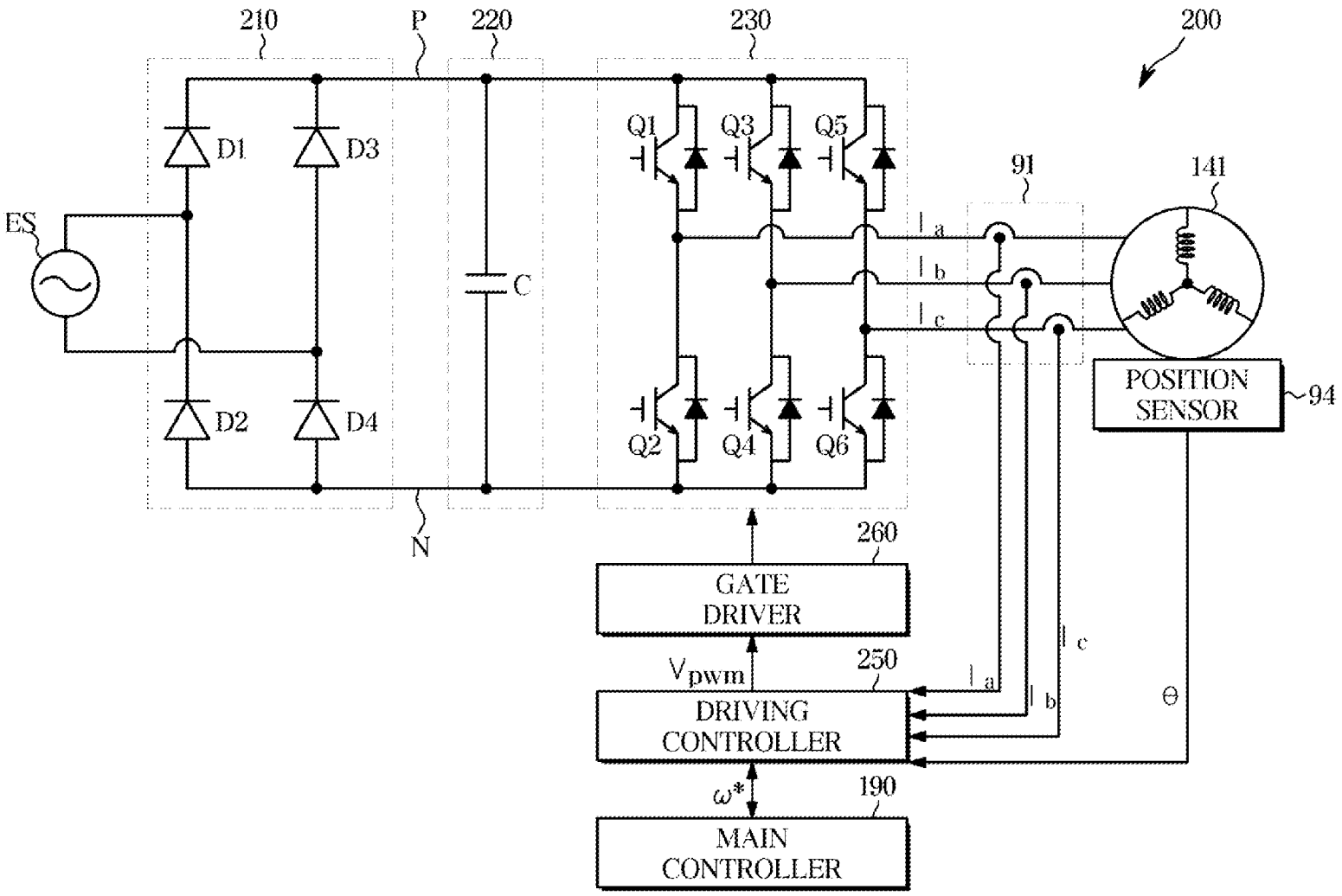
FIG. 4 illustrates an example of a driving circuit included in a washing machine, according to an embodiment.
Figure 5:
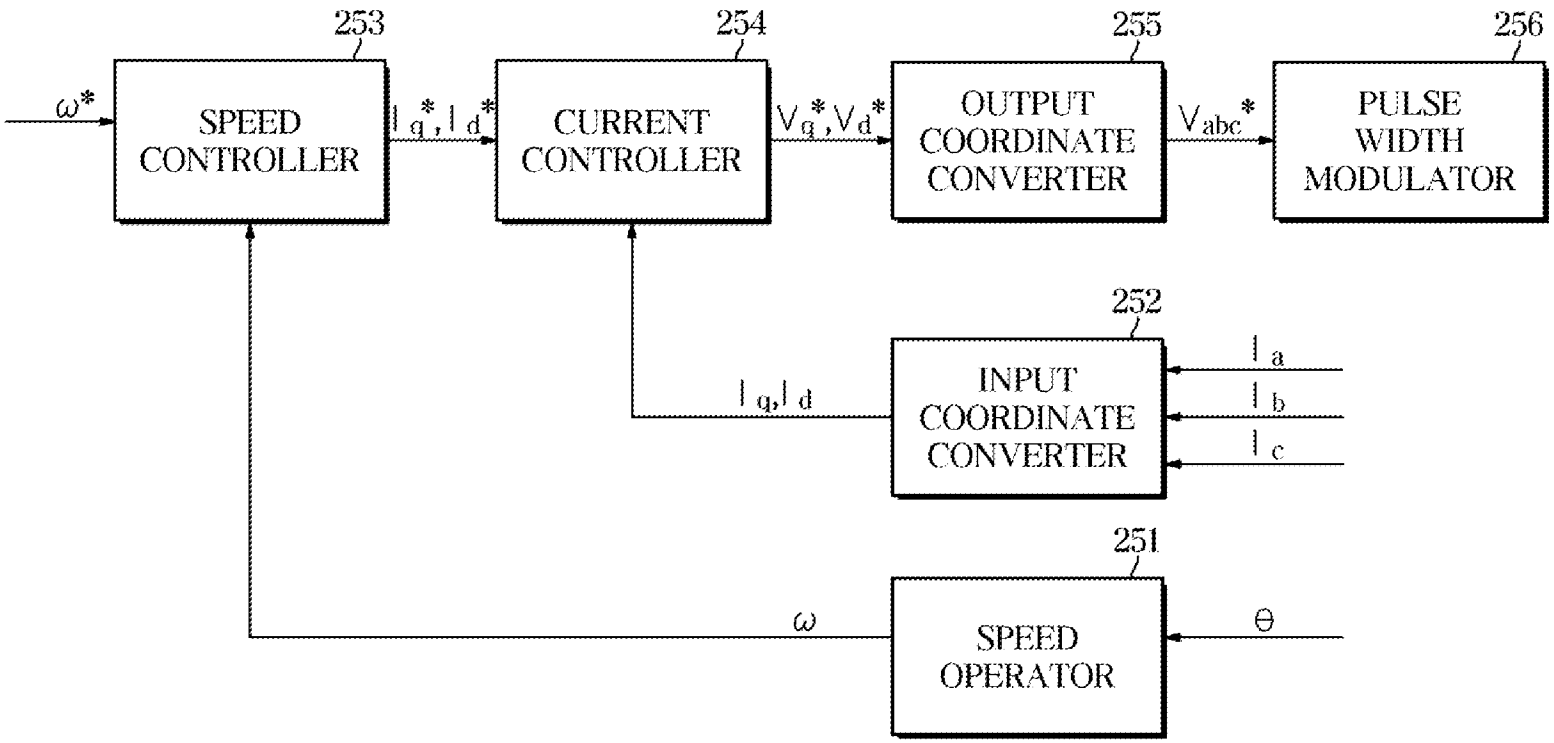
FIG. 5 illustrates an example of a controller included in a washing machine, according to an embodiment.

FIG. 3 is a control block diagram of the washing machine 100, according to an embodiment, FIG. 4 illustrates an example of a driving circuit 200 included in the washing machine 100, according to an embodiment, and FIG. 5 illustrates an example of a controller 190 included in the washing machine 100, according to an embodiment.

In addition to the mechanical components descried in connection with FIGS. 1 and 2, the washing machine 100 may also include electrical/electronic components as will be described below.

Referring to FIGS. 3, 4 and 5, the washing machine 100 may include the control panel 110, a sensor module 90, the driver 140, the water supplier 150, the drain 160, and the controller 190.

The control panel 110 may include an input button for obtaining a user input, and a display for displaying a laundry setting and/or laundry operation information in response to the user input. In other words, the control panel 110 may provide an interface (hereinafter, referred to as a user interface) for interaction between the user and the washing machine 100.

The input button may include, for example, a power button, a start button, a course selection dial, and a detailed setting button. The input button may include, for example, a tact switch, a push switch, a slide switch, a toggle switch, a micro switch, or a touch switch.

The display includes a screen for displaying a laundry course selected by turning the course selection dial and an operation time of the washing machine 100, and an indicator for indicating detailed settings selected by the setting button. Furthermore, the display may provide a user interface for selecting a noise reduction mode during washing, as will be described later. The display may include, for example, a liquid crystal display (LCD) panel, a light emitting diode (LED), or the like.

In this case, the laundry course may include laundry settings (e.g., washing temperature, the number of rinsing times, dehydration intensity, etc.) set in advance by a designer of the washing machine 100 based on the type of clothes (e.g., bedclothes, underwear, etc.) and texture (e.g., wool). For example, standard washing may include a laundry setting that may be applied to most clothes, and bedclothes washing may include a washing setting optimized for washing the bedclothes. The laundry course may be classified into, for example, standard washing, powerful washing, wool washing, bedclothes washing, infant clothes washing, towel washing, minimal washing, boiling washing, economic washing, outdoor clothes washing, rinsing/dehydrating, dehydrating, etc.

The sensor module 90 may include at least one of a plurality of sensors 91, 92, 93 and 94 for outputting various sensing values required to control rotation speed of the motor 141.

For example, the sensor module 90 may include at least one of the sensors 91, 92 and 93 for outputting sensing values that vary by weight of the clothes, and may further include the sensor 94 for outputting a sensing value that varies by rotation angle of the motor 141.

The current sensor 91 may output a value of a current applied to the motor 141, and there is no limitation on the number. The current sensor 91 may be arranged in any position that allows outputting the value of the current applied to the motor 141. For example, the current sensor 91 may be provided for each of all three phases in a three-phase circuit to measure all the three-phase currents. In certain embodiments, the current sensor 91 may be provided for each of only two phases in the three-phase circuit or provided at a drain terminal N of lower switching circuits Q2, Q4 and Q6 of an inverter circuit.

The voltage sensor 92 may output a value of a voltage applied to the motor 141, and there is no limitation on the number. The voltage sensor 92 may be arranged in any position that allows outputting the value of the voltage applied to the motor 141.

The power sensor 93 may output a value of power applied to the motor 141, and there is no limitation on the number. The power sensor 93 may be arranged in any position that allows outputting the value of the power applied to the motor 141.

The driver 140 may include the driving circuit 200 and the motor 141 configured to rotate according to a driving current applied from the driving circuit 200.

The driving circuit 200 may apply a driving current to the motor 141 for driving the motor 141, in response to a driving signal from the controller 190.

As shown in FIG. 4, the driving circuit 200 may include a rectifying circuit 210 for rectifying alternate current (AC) power from an external power source ES, a direct current (DC) link circuit 220 for eliminating ripples of the rectified power and outputting DC power, an inverter circuit 230 for converting the DC power to sinusoidal driving power and outputting a driving current Iabc to the motor 141, the current sensor 91 for measuring driving currents Ia, Ib, and Ic applied to the motor 141, a driving controller 250 for controlling driving power conversion of the inverter circuit 230, and a gate driver 260 for turning on or off switching circuits Q1, Q2, Q3, Q4, Q5 and Q6 included in the inverter circuit 230 based on a driving signal from the driving controller 250.

Furthermore, the position sensor 94 for measuring a position (an electrical angle) of the rotor 143 of the motor 141 may be provided on each motor 141.

The rectifying circuit 210 may include a diode bridge including a plurality of diodes D1, D2, D3 and D4. The diode bridge is arranged between a positive terminal P and a negative terminal N of the driving circuit 200. The rectifying circuit 210 may rectify the AC power (AC voltage and AC current) that changes in magnitude and direction over time to power having a constant direction.

The DC link circuit 220 includes a DC link capacitor C for storing electric energy. The DC link capacitor C is arranged between the positive terminal P and the negative terminal N of the driving circuit 200. The DC link circuit 220 may receive the power rectified by the rectifying circuit 210 and output DC power with a constant magnitude and direction.

The inverter circuit 230 may include three pairs of switching devices Q1 and Q2, Q3 and Q4, and Q5 and Q6 arranged between the positive terminal P and the negative terminal N of the driving circuit 200. Specifically, the inverter circuit 230 may include a plurality of upper switching devices Q1, Q3 and Q5 and a plurality of lower switching devices Q2, Q4 and Q6.

The switching device pairs Q1 and Q2, Q3 and Q4 and Q5 and Q6 may each include two switching devices Q1 and Q2, Q3 and Q4 or Q5 and Q6 connected in series. The switching devices Q1, Q2, Q3, Q4, Q5 and Q6 included in the inverter circuit 230 may each be turned on/off by an output of the gate driver 260, so that 3-phase driving currents Ia, Ib, and Ic may be applied to the motor 141.

The current sensor 91 may measure the 3-phase driving currents (a-phase current, b-phase current and c-phase current) output from the inverter circuit 230, and output data representing the measured 3-phase driving current values Ia, Ib, Ic: Iabc to the driving controller 250. Alternatively, the current sensor 91 may measure only 2-phase driving currents among the 3-phase driving currents Iabc, and the driving controller 250 may expect the other phase driving current from the two-phase driving currents.

The position sensor 94 may be arranged on the motor 141 for measuring a position Θ (e.g., an electrical angle) of the rotor 143 of the motor 141 and outputting position data representing the electrical angle θ of the rotor 143. The position sensor 94 may be implemented by a hall sensor, an encoder, a resolver, or the like.

The gate driver 260 may output a gate signal to turn on/off the plurality of switching circuits Q1, Q2, Q3, Q4, Q5 and Q6 included in the inverter circuit 230 based on an output of the driving controller 250.

The driving controller 250 may be provided separately from the controller 190. The driving controller 250 may include an application specific integrated circuit (ASIC) for outputting a driving signal based on e.g., a rotation speed command ω*, the driving current value Iabc and a position Θ of the rotor. Alternatively, the driving controller 250 may include a memory for storing a series of instructions for outputting a driving signal based on the rotation speed command ω*, the driving current value Iabc, and the rotor position Θ, and a processor for processing the series of instructions stored in the memory.

The driving controller 250 may be provided integrally with the controller 190. For example, the driving controller 250 may be implemented with a series of instructions for outputting a driving signal based on the rotation speed command ω*, the driving current value Iabc, and the rotor position Θ stored in the memory 192 of the controller 190.

The driving controller 250 may receive a motor control signal (e.g., a rotation speed command) from the controller 190, receive the driving current value Iabc from the current sensor 91, and receive the rotor position Θ of the motor 141 from the position sensor 94. The driving controller 250 may determine a driving current value to be applied to the motor 141 based on the rotation speed command ω*, the driving current value Iabc and the rotor position Θ, and output a driving signal (pulse width modulation (PWM) signal) for controlling the inverter circuit 230 based on the determined driving current value.

The driving controller 250 may include a speed operator 251, an input coordinate converter 252, a speed controller 253, a current controller 254, an output coordinate converter 255 and a pulse width modulator 256, as shown in FIG. 5.

The speed operator 251 may calculate a rotation speed value ω of the motor 141 based on the electrical angle θ of the rotor of the motor 141. The electrical angle θ of the rotor may be received from the position sensor 94 arranged on the motor 141. For example, the speed operator 251 may calculate the rotation speed value ω of the motor 141 based on a change in the electrical angle θ of the rotor 143 for a sampling time interval.

When there is no position sensor 94 provided in an embodiment of the disclosure, the speed operator 251 may calculate the rotation speed value ω of the motor 141 based on the driving current value Iabc measured by the current sensor 91.

An input coordinate converter 252 may convert the 3-phase driving current value Iabc into d-axis current value Id and q-axis current value Iq (hereinafter, d-axis current and q-axis current) based on the electrical angle θ of the rotor. In other words, the input coordinate converter 252 may perform axial conversion on the a-axis, the b-axis, and the c-axis of the 3-phase driving current value Iabc into the d-axis and the q-axis. In this case, the d-axis refers to an axis in a direction corresponding to a direction of a magnetic field produced by the rotor of the motor 141, and the q-axis refers to an axis in a direction ahead by 90 degrees of a direction of the magnetic field produced by the rotor of the motor 141. The 90 degrees refer to an electrical angle rather than a mechanical angle of the rotor, and the electrical angle refers to a converted angle according to which an angle between neighboring N poles or neighboring S poles of the rotor is converted into 360 degrees.

Furthermore, the d-axis current may represent a current component of the driving current, which produces a magnetic field in the d-axis direction, and the q-axis current may represent a current component of the driving current, which produces a magnetic field in the q-axis direction.

The input coordinate converter 252 may calculate the q-axis current value Iq and the d-axis current value Id from the 3-phase driving current value Iabc according to a known method.

The speed controller 253 may compare the rotation speed command ω* from the controller 190 with the rotation speed value ω of the motor 141, and output a q-axis current command Iq* and a d-axis current command Id* based on a result of the comparing. For example, the speed controller 253 may use proportional integral control (PI control) to calculate the q-axis current command Iq* and the d-axis current command Id* to be applied to the motor 141 based on a difference between the rotation speed command ω* and the rotation speed value w.

The current controller 254 may compare the q-axis current command Iq* and the d-axis current command Id* output from the speed controller 253 with the q-axis current value Iq and the d-axis current value Id output from the input coordinate converter 252, and output a q-axis voltage command Vq* and a d-axis voltage command Vd* based on a result of the comparing. Specifically, the current controller 254 may use PI control to determine the q-axis voltage command Vq* based on a difference between the q-axis current command Iq* and the q-axis current value Iq and determine the d-axis voltage command Vd* based on a difference between the d-axis current command Id* and the d-axis current value Id.

The output coordinate converter 255 may convert a dq-axis voltage command Vdq* into 3-phase voltage commands (an a-phase voltage command, a b-phase voltage command, and a c-phase voltage command) vatic* based on the electrical angle θ of the rotor of the motor 141.

The output coordinate converter 255 may convert the dq-axis voltage Vdq* to the 3-phase voltage command Vabc* according to a known method.

The pulse width modulator 256 may generate a PWM control signal Vpwm to turn on or turn off the switching circuits Q1, Q2, Q3, Q4, Q5 and Q6 of the inverter circuit 230 from the 3-phase voltage command Vabc*. Specifically, the pulse width modulator 256 may perform PWM on the 3-phase voltage command Vabc* and output a PWMed PWM signal Vpwm to the gate driver 260.

As such, the driving controller 250 may output a driving signal (PWM signal) to the gate driver 260 based on a motor control signal (e.g., a rotation speed command) from the controller 190. Furthermore, the driving controller 250 may provide the driving current value Iabc, the dq-axis current value Idq and the dq-axis current command Idq* to the controller 190.

As described above, the driving circuit 200 may apply a driving current to the motor 141 based on a motor control signal (e.g., a rotation speed command or a rotation deceleration command) from the controller 190.

The motor 141 may rotate the drum 130 depending on the driving current from the driving circuit 200. For example, the motor 141 may rotate the drum 130 based on the driving current so that the rotation speed of the drum 130 follows a rotation speed command output from the controller 190.

Furthermore, the motor 141 may decelerate the drum 130 so that the rotation speed of the drum 130 follows a rotation deceleration command output from the controller 190.

The water supply valve 152 may remain in the closed state in ordinary times, and may be opened in response to a water supply signal from the controller 190. As the water supply valve 152 is opened, water may be supplied into the tub 120 through the water supply conduit 151.

The drain pump 162 may pump the water in the drain conduit 161 out of the cabinet 101 in response to a drain signal from the controller 190. By the pumping of the drain pump 162, the water stored in the tub 120 may be discharged out of the cabinet 101 through the drain conduit 161.

For example, the controller 190 may be mounted on a printed circuit board provided on the rear surface of the control panel 110.

The controller 190 may be electrically connected to the control panel 110, the sensor module 90, the driver 140, the water supplier 150, and the drain 160.

The controller 190 may include a processor 191 for generating a control signal to control operation of the washing machine 100, and a memory 192 for memorizing or storing a program and data for generating the control signal to control the operation of the washing machine 100. The processor 191 and the memory 192 may be implemented with separate semiconductor devices or in a single semiconductor device. The controller 190 may include a plurality of processors 191 and a plurality of memories 192.

The processor 191 may process data and/or a signal based on the program provided from the memory 192, and provide a control signal to each component of the washing machine 100 based on the processing result.

The processor 191 may receive a user input from the control panel 110 and process the user input.

The processor 191 may output the control signal to control the motor 141, the water supply valve 152, the drain pump 162 and the door lock in response to the user input. For example, the processor 191 may control the motor 141, the water supply valve 152, the drain pump 162 and the door lock to sequentially perform a washing course, a rinsing course and a spin-drying course. Furthermore, the processor 191 may output a control signal to control the control panel 110 to display a laundry setting and laundry operation information in response to the user input.

For example, the processor 191 may control the control panel 110 to display a user interface for activating a noise reduction mode.

The processor 191 may output a motor control signal to the driving circuit 200 to rotate the motor 141 at high speed during the spin-drying course of the washing machine 100. During the spin-drying course of the washing machine 100, the processor 191 may receive information about a driving current (e.g., the d-axis current value, the q-axis current value, the d-axis current command, the q-axis current command, etc.) of the motor 141 from the driving circuit 200, and output a motor control signal to the driving circuit 200 to control rotation speed of the motor 141 based on the driving current of the motor 141.

For example, during the spin-drying course, the processor 191 may output, to the driving circuit 200, the motor control signal for accelerating the motor 141 to first rotation speed and then decelerating the motor 141 to second rotation speed, accelerating the motor 141 to third rotation speed after decelerating the motor 141 to the second rotation speed, and decelerating the motor 141 to fourth rotation speed after accelerating the motor 141 to the third rotation speed.

The processor 191 may include an operation circuit, a storage circuit, and a control circuit. The processor 191 may include one or multiple chips. Furthermore, the processor 191 may include one or multiple cores.

The memory 192 may memorize/store a program for controlling a laundry operation according to a laundry course and data including a laundry setting according to the laundry course. Furthermore, the memory 192 may memorize/store a laundry course and a laundry setting currently selected based on a user input.

The memory 192 may include a volatile memory, such as a static random access memory (S-RAM), a dynamic RAM (D-RAM), or the like, and a non-volatile memory, such as a read only memory (ROM), an erasable programmable ROM (EPROM) or the like. The memory 192 may include a memory device, or multiple memory devices.

As described above, the washing machine 100 may accelerate or decelerate the motor 141 based on a change in driving current (e.g., the q-axis current value or the q-axis current command) of the motor 141 during the spin-drying course.

Figure 6:
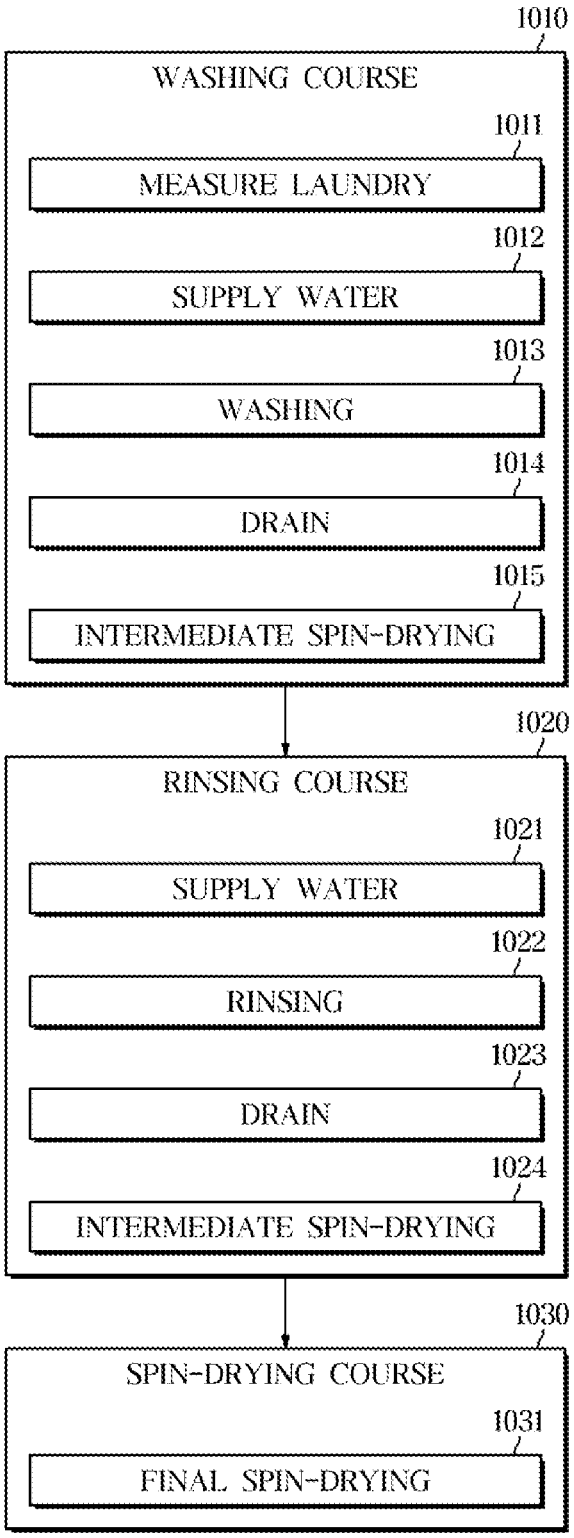
FIG. 6 illustrates an example of an operation of a washing machine, according to an embodiment.

FIG. 6 illustrates an example of an operation of a washing machine, according to an embodiment.

Referring to FIG. 6, the washing machine 100 may perform a washing course 1010, a rinsing course 1020 and a spin-drying course 1030 sequentially according to a user input.

Clothes may be washed by the washing process 1010. Specifically, dirt on the clothes may be separated by chemical actions of a detergent and/or mechanical actions such as falling.

The washing course 1010 may include laundry measurement 1011 for measuring an amount of clothes, water supply 1012 for supplying water into the tub 120, washing 1013 for washing the clothes by rotating the drum 130 at low speed, draining 1014 for draining water contained in the tub 120, and intermediate spin-drying 1015 for separating water from the clothes by rotating the drum 130 at high speed.

For the washing 1013, the controller 190 may control the driving circuit 200 to rotate the motor 141 in forward direction or reverse direction. Due to the rotation of the drum 130, the clothes may be washed by falling down the drum 130.

For the intermediate spin-drying 1015, the controller 190 may control the driving circuit 200 to rotate the motor 141 at high speed. Due to the high-speed rotation of the drum 130, water may be separated from the clothes contained in the drum 130 and drained out of the washing machine 100.

The rotation speed of the drum 130 may gradually increase during the intermediate spin-drying 1015. For example, the controller 190 may control the driving circuit 200 to rotate the motor 141 at a first rotation speed, and control the motor 141 so that the rotation speed of the motor 141 increases to a second rotation speed based on a change in driving current to the motor 141 while the motor 141 is rotating at the first rotation speed. The controller 190 may control the motor 141 so that the rotation speed of the motor 141 increases to a third rotation speed or the rotation speed of the motor 141 decreases to the first rotation speed based on a change in driving current of the motor 141 while the motor 141 is rotated at the first rotation speed.

The clothes may be rinsed by the rinsing process 1020. Specifically, the remnants of the detergent or dirt on the clothes may be washed by water.

The rinsing process 1020 may include water supply 1021 for supplying water into the tub 120, rinsing 1022 for rinsing the clothes by driving the drum 130, draining 1023 for draining water contained in the tub 120, and intermediate spin-drying 1024 for separating water from the clothes by driving the drum 130.

The water supply 1021, draining 1023 and intermediate spin-drying 1024 of the rinsing process 1020 may correspond to the water supply 1012, draining 1014 and intermediate spin-drying 1015 of the washing process 1010. During the rinsing process 1020, the water supply 1021, the rinsing 1022, the draining 1023 and the intermediate spin-drying 1024 may be performed one or multiple times.

The clothes may be dehydrated by the spin-drying process 1030. Specifically, water may be separated from the clothes by high-speed rotation of the drum 130, and the separated water may be discharged out of the washing machine 100.

The spin-drying process 1030 may include final spin-drying 1031 to separate water from the clothes by rotating the drum 130 at high speed. With the final spin-drying 1031, the last intermediate spin-drying 1024 of the rinsing process 1020 may be skipped.

For the final spin-drying 1031, the controller 190 may control the driving circuit 200 to rotate the motor 141 at high speed. Due to the high-speed rotation of the drum 130, water may be separated from the clothes contained in the drum 130 and drained out of the washing machine 100. The rotation speed of the motor 141 may gradually increase.

As the operation of the washing machine 100 is completed with the final spin-drying 1031, performance time of the final spin-drying 1031 may be longer than performance time of the intermediate spin-drying 1015 or 1024.

As described above, the washing machine 100 may perform the washing course 1010, the rinsing course 1020 and the spin-drying course 1030 to do the laundry. During the intermediate spin-drying 1015 and 1024 and the final spin-drying 1031 in particular, the washing machine 100 may gradually increase the rotation speed of the motor 141 for rotating the drum 130, and increase or decrease the rotation speed of the motor 141 based on a change in driving current to the motor 141.

The spin-drying course as mentioned throughout the specification may refer to all of the intermediate spin-drying 1015 performed in the washing course 1010, the intermediate spin-drying 1024 performed in the rinsing course 1020, the final spin-drying 1031 performed in the spin-drying course 1030, but in the following description, the spin-drying course is assumed to be the final spin-drying 1031 in the spin-drying course 1030 performed after the rinsing course 1020.

Figure 7A:
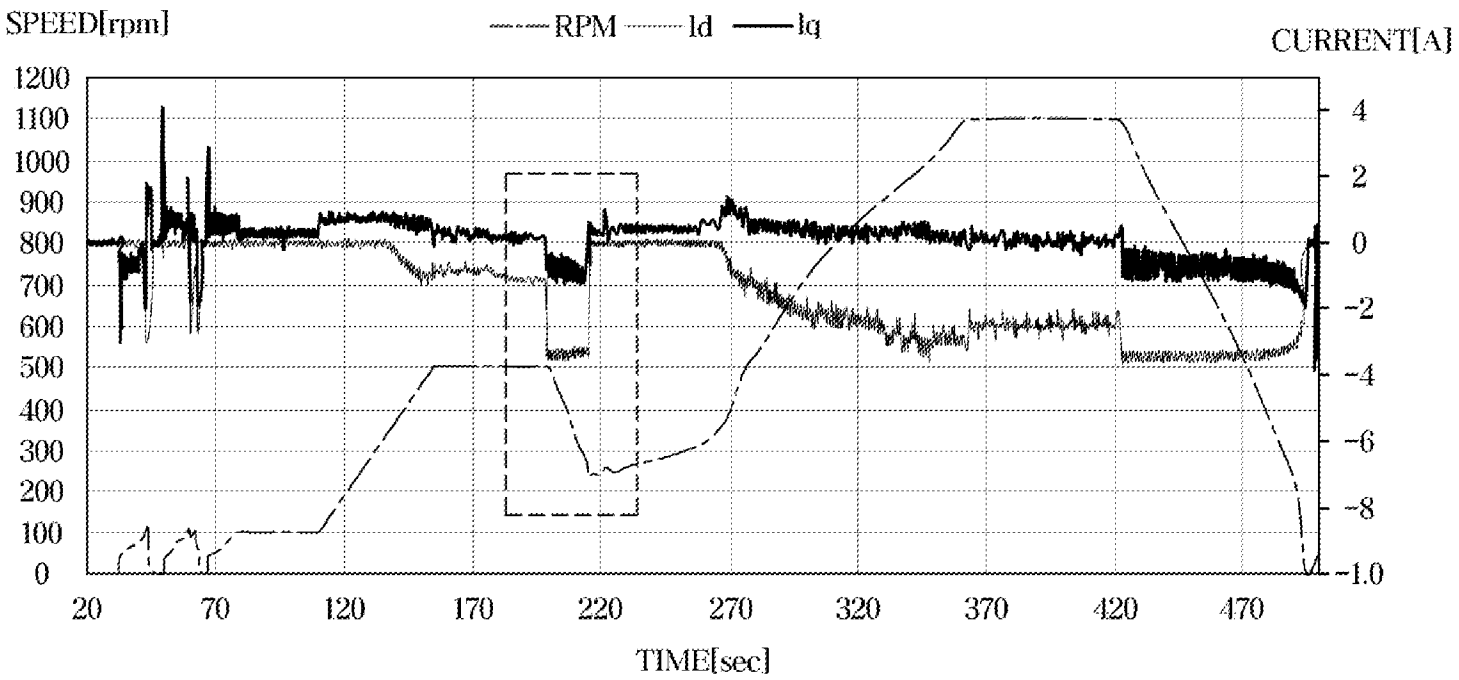
FIG. 7A illustrates a spin-drying course speed profile when a noise reduction mode of a wishing machine is deactivated, according to an embodiment.
Figure 7B:
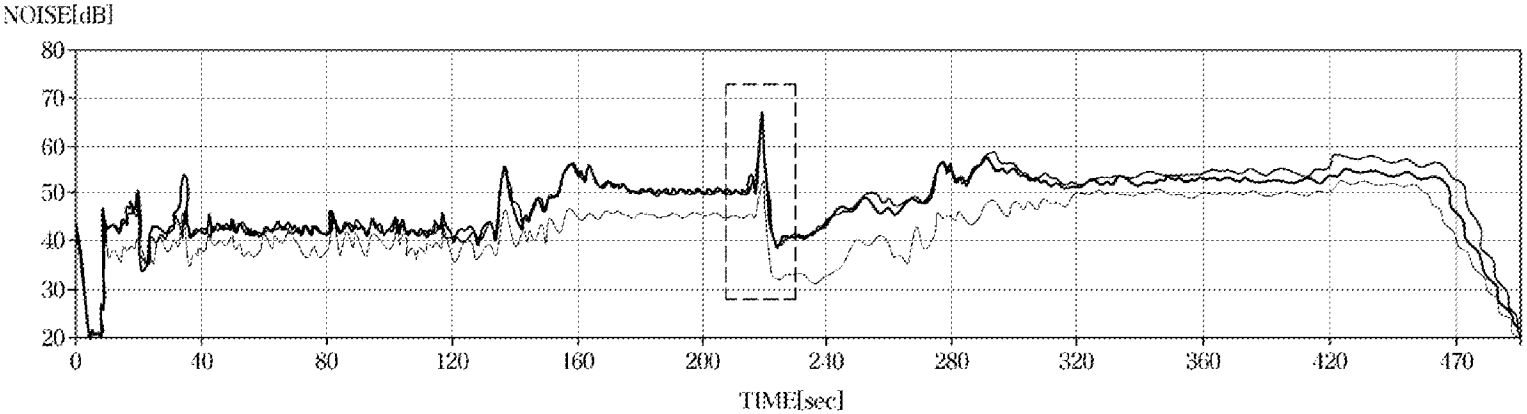
FIG. 7B illustrates levels of noise occurring in a spin-drying course when a noise reduction mode of a wishing machine is deactivated, according to an embodiment.

FIG. 7A illustrates a spin-drying course speed profile when a noise reduction mode of a wishing machine is deactivated, according to an embodiment, and FIG. 7B illustrates levels of noise occurring in a spin-drying course when a noise reduction mode of a wishing machine is deactivated, according to an embodiment.

Referring to FIG. 7A, when entering into the spin-drying course in an activated noise reduction mode, the washing machine 100 in an embodiment may accelerate the motor 141 (or the drum 130) to the first rotation speed (e.g., 500 rpm) and maintain the first rotation speed for a preset period of time.

In other words, the controller 190 may control the driving circuit 200 to accelerate the motor 141 up to the first rotation speed, and in response to the rotation speed of the motor 141 reaching the first rotation speed, control the driving circuit 200 to maintain the rotation speed of the motor 141 to be the first rotation speed for the preset period of time.

In response to the rotation speed of the motor 141 maintained at the first rotation speed for the preset period of time, the controller 190 may decelerate the motor 141 to the second rotation speed (e.g., 250 rpm) (first deceleration section).

Specifically, the controller 190 may control the driving circuit 200 to turn off the upper switching devices Q1, Q3 and Q5 and turn on the lower switching devices Q2, Q4 and Q6 of the inverter circuit, so that the motor 141 may be decelerated to the second rotation speed in a short braking method.

The purpose of decelerating the motor 141 to the second rotation speed is to reduce disproportion of the clothes, i.e., prevent the clothes from being lopsided in the drum when the motor 141 is rotated at high speed from the beginning of the spin-drying course.

Afterward, the controller 190 may control the driving circuit 200 to accelerate the motor 141 to the third rotation speed (e.g., 1100 rpm) in response to the deceleration of the motor 141 to the second rotation speed.

In response to the rotation speed of the motor 141 reaching the third rotation speed, the controller 190 may control the driving circuit 200 to maintain the rotation speed of the drum motor 141 at the third rotation speed.

In response to the rotation speed of the motor 141 maintained at the third rotation speed for the preset period of time, the controller 190 may decelerate the motor 141 to the fourth rotation speed (e.g., 0 rpm, which is a stopped state) to stop the spin-drying course (a second deceleration section).

Even in this case, the controller 190 may control the driving circuit 200 to turn off the upper switching devices Q1, Q3 and Q5 and turn on the lower switching devices Q2, Q4 and Q6 of the inverter circuit, so that the motor 141 may be decelerated to the fourth rotation speed in the short braking method.

As described above, the preset rotation speeds satisfy the following relations: third rotation speed>first rotation speed>second rotation speed>fourth rotation speed.

The information about the first to fourth rotation speeds may be stored in the memory 192 in advance and may be changed according to the weight of the laundry.

Referring to FIG. 7B, when the controller 190 controls the driving circuit 200 to decelerate the motor 141 that is rotating at the first rotation speed to the second rotation speed, a sum of magnitudes of the d-axis current and the q-axis current increases, which causes occurrence of abnormal noise from the motor 141. The abnormal noise occurring in the motor 141 may give unpleasant feeling to the user and even to his/her neighbors.

As described above, when the motor 141 is decelerated in the short braking method, a lot of current flows to the motor 141, which may cause the abnormal noise. Furthermore, as the decelerating of the motor 141 that is rotating at the first rotation speed in the short braking method causes louder noise than the original noise occurring from the motor 141 rotating at the first rotation speed, the user may feel the noise even louder.

On the other hand, as the noise occurring from the motor 141 that is rotating at the third rotation speed is louder than the noise occurring from the motor 141 that is rotating at the first rotation speed, the user may feel the noise less when the motor 141 that is rotating at the third rotation speed is decelerated in the short braking method.

In other words, the noise that gives unpleasant feeling to the user occurs in the first deceleration section in which the motor is decelerated from the first rotation speed to the second rotation speed rather than the second deceleration section in which the motor is decelerated from the third rotation speed to the fourth rotation speed.

In an embodiment, the washing machine 100 may decelerate the motor 141 in a deceleration control method instead of the short braking method in the first deceleration section so as to reduce the noise occurring in the first deceleration section.

The deceleration control method may refer to a method by which the controller 190 generates PWM control signal Vpwm to turn on or turn off the switching circuits Q1, Q2, Q3, Q4, Q5 and Q6 of the inverter circuit 230 to apply a negative current to the motor 141.

This will be described in detail in connection with FIGS. 8 to 12.

Figure 8:
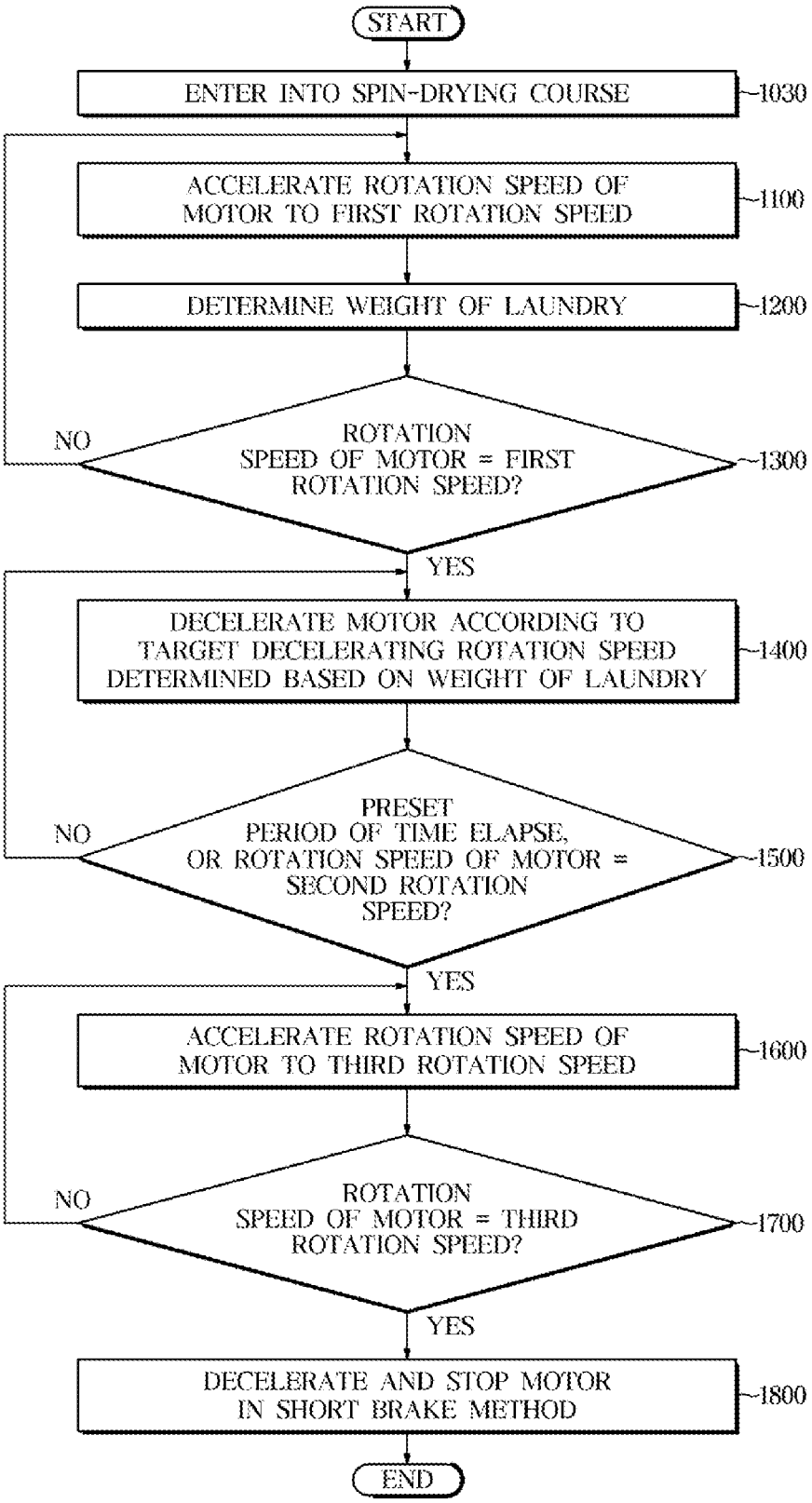
FIG. 8 is a flowchart of a controlling method for a washing machine, according to an embodiment.
Figure 9:
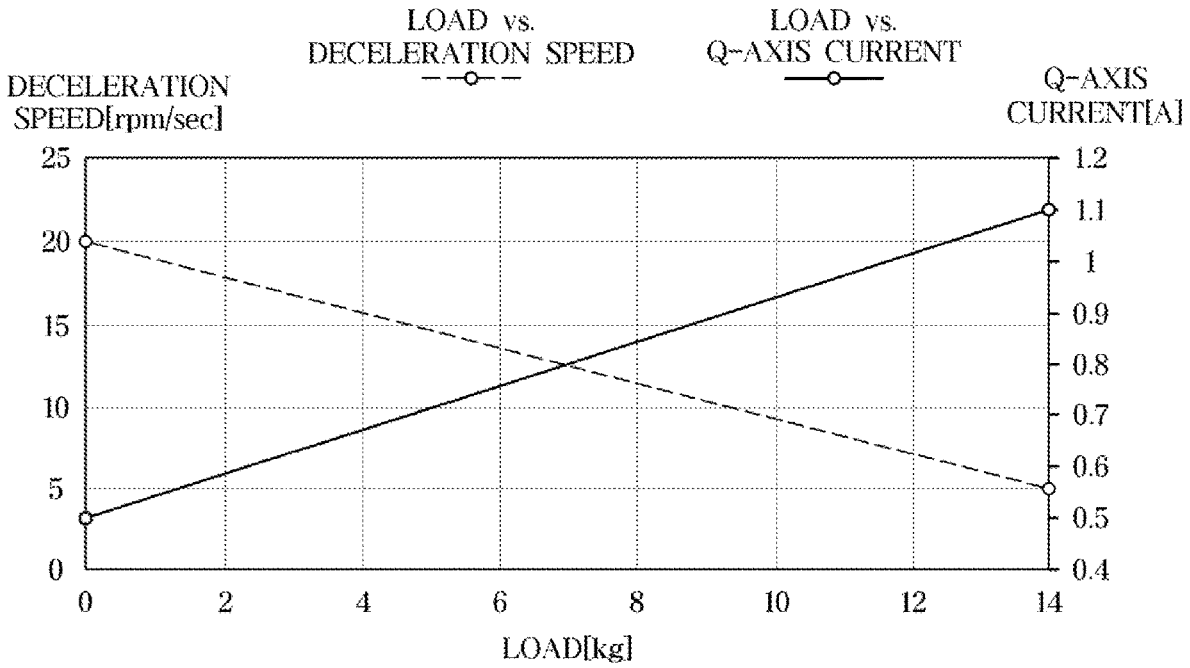
FIG. 9 illustrates correlations between laundry weight and current and correlations between laundry weight and deceleration speed.
Figure 11A:
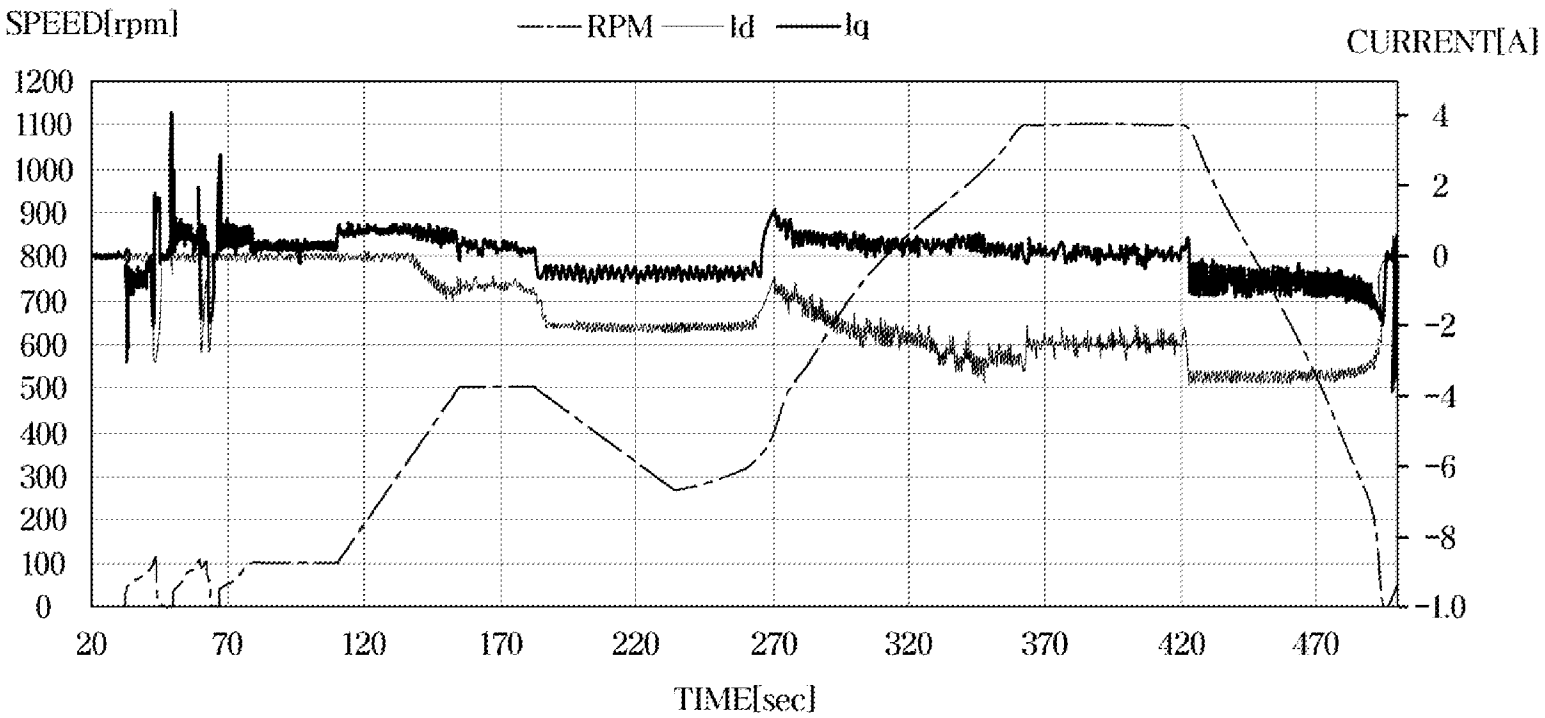
FIG. 11A illustrates a spin-drying course speed profile of a washing machine, according to an embodiment.
Figure 11B:
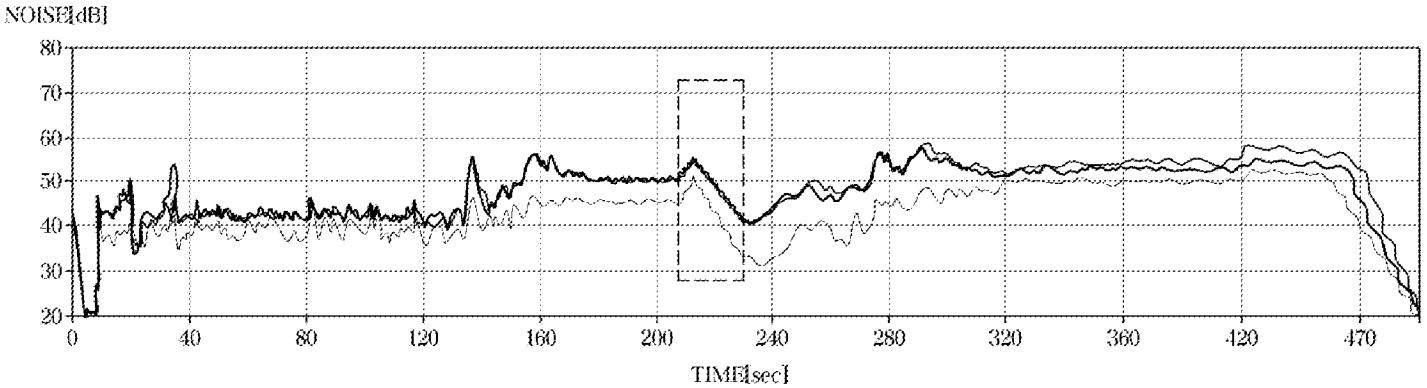
FIG. 11B illustrates levels of noise occurring in a spin-drying course of a wishing machine, according to an embodiment.
Figure 12:
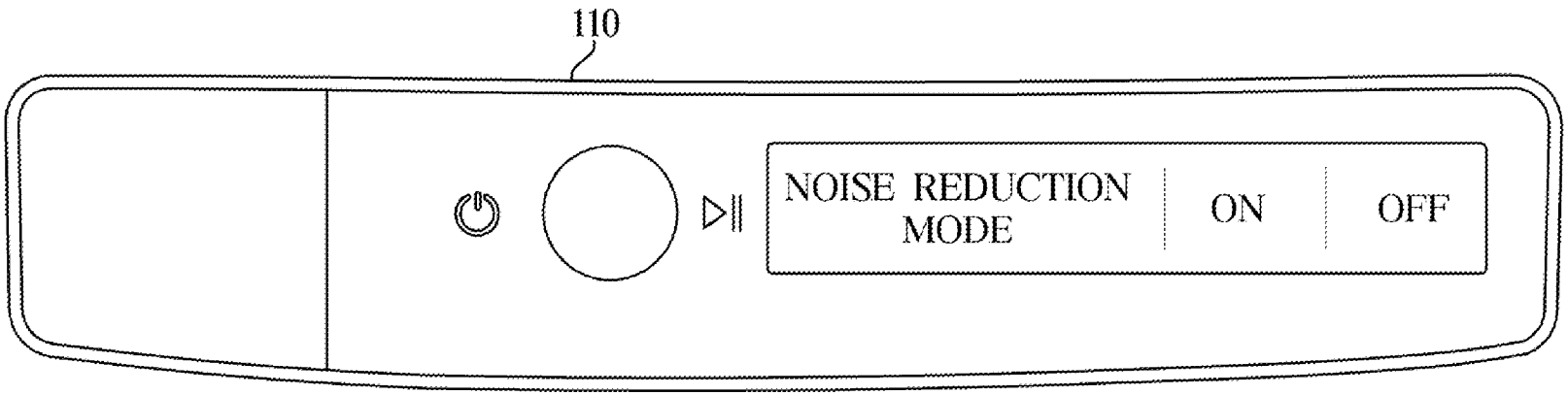
FIG. 12 illustrates an example of a screen displayed on a control panel included in a washing machine, according to an embodiment.

FIG. 8 is a flowchart of a controlling method for a washing machine, according to an embodiment, FIG. 9 illustrates correlations between laundry weight and current and correlations between laundry weight and deceleration speed, FIG. 10 illustrates deceleration time and whether high voltage is generated by an inverter in different deceleration methods, FIG. 11A illustrates a spin-drying course speed profile of a washing machine, according to an embodiment, FIG. 11B illustrates levels of noise occurring in a spin-drying course of a wishing machine, according to an embodiment, and FIG. 12 illustrates an example of a screen displayed on a control panel included in a washing machine, according to an embodiment.

Referring to FIG. 8, the washing machine 100 in an embodiment may enter into a spin-drying course in 1030.

In response to the washing machine 100 entering into the spin-drying course, the controller 190 may accelerate the rotation speed of the motor 141 to a target rotation speed (hereinafter, the first rotation speed), in 1100. Specifically, the controller 190 may output a control command to the driving circuit 200 for the motor 141 to reach the first rotation speed.

Before the motor 141 reaches the first rotation speed, the controller 190 may determine weight of the laundry based on a sensing value output from the sensor module 90, in 1200.

The sensing value that varies by the weight of the laundry may refer to a value of a current applied to the motor 141, a value of a voltage applied to the motor 141, or a value of power applied to the motor 141, in which case the sensor may refer to the current sensor 91, the voltage sensor 92 or the power sensor 93.

For example, the controller 190 may determine the weight of the laundry based on the current value output from the current sensor 91, and more particularly, determine the weight of the laundry based on the q-axis current value calculated from the current value output from the current sensor 91.

Referring to FIG. 9, relations between the weight of the laundry and the q-axis current may be determined. When the weight of the laundry is to be determined by the q-axis current, the weight of the laundry may be determined by further taking a degree of unbalance of the laundry into account.

In an embodiment, when the motor 141 reaches a preset rotation speed (e.g., 300 rpm) lower than the first rotation speed, the controller 190 may determine the weight of the laundry based on the sensing value output from the current sensor 91, the voltage sensor 92 or the power sensor 93.

The preset speed lower than the first rotation speed may be set to be a speed higher than half the first rotation speed, and accordingly, the controller 190 may determine the weight of the laundry accurately before the first deceleration section.

In another embodiment, the controller 190 may determine the weight of the laundry by using a weight value of wet clothes in the beginning of spin-drying, which is detected when entering into the spin-drying course.

As such, various known methods may be used to determine the weight of the laundry.

When the motor 141 is accelerated to the first rotation speed in 1300, the controller 190 may maintain the rotation speed of the motor 141 at the first rotation speed for a preset period of time.

The controller 190 may then control the driving circuit 200 to decelerate the motor 141 according to a target decelerating rotation speed determined based on the weight of the laundry, in 1400. As such, unlike the traditional washing machine, the washing machine 100 according to an embodiment may reduce noise occurring in the first deceleration section by decelerating the motor 141 according to the target decelerating rotation speed in the deceleration control method instead of decelerating the motor 141 in the short braking method.

The controller 190 may determine the target decelerating rotation speed based on the weight of the laundry, and more specifically, may determine the level of the target decelerating rotation speed to based on an inverse relationship with the weight of the laundry. In other words, a lower level of the target decelerating rotation speed can be determined for a heavier weight of the laundry.

For this, the target decelerating rotation speed values determined corresponding to the weight of the laundry may be stored in the memory 192.

Turning back to FIG. 9, the correlation between the q-axis current value and the target decelerating rotation speed and the correlation between the weight of the laundry and the target decelerating rotation speed may be determined.

A look-up table or equations of the correlations shown in FIG. 9 may be stored in the memory 192, and the controller 190 may determine the target decelerating rotation speed corresponding to the weight of the laundry or the corresponding q-axis current value.

In the case of using the deceleration control method without using the short braking method, a negative current needs to be applied to the motor 141 to decelerate the motor 141.

Specifically, to decelerate the motor 141 according to the target decelerating rotation speed, the controller 190 may control the driving circuit 200 to decelerate the motor 141 by applying a negative current to the motor 141.

When the negative current is applied to the motor 141, the capacitor C included in the DC link circuit 220 is charged with a high voltage, which may damage the inverter circuit 230.

Accordingly, the target decelerating rotation speed needs to be determined to be a proper decelerating speed, which prevents the DC link capacitor C from being charged with a preset voltage or more and allows the motor 141 to be decelerated in a shortest time.

Specifically, referring to FIG. 10, it may be determined that decelerating the motor 141 in the short braking method is most efficient in terms of deceleration time. In the case of performing deceleration control to reduce noise occurrence, it may be determined that the deceleration time decreases as the deceleration speed increases, but when a particular deceleration speed is reached, it causes high voltage in the inverter circuit.

It may also be determined that the particular deceleration speed that causes high voltage in the inverter circuit varies by the weight of the laundry. It is because motor torque increases the heavier the weight of the laundry and the higher the deceleration speed, and the motor torque is proportional to the negative current applied to the motor 141.

As shown in FIG. 10, high voltage is not caused in the inverter circuit even when the deceleration speed increases up to 20 rpm/sec while no laundry is contained in the drum 130, but high voltage is caused in the inverter circuit when the deceleration speed increases up to 7 rpm/sec while the drum 130 contains a laundry of 14 kg.

In other words, the deceleration time may be shortened by increasing the deceleration speed because the deceleration torque is small when the load is small, but when the load is large, the deceleration torque is large, which prevents increase of the deceleration speed.

By taking this into account, the washing machine 100 according to an embodiment determines an optimal target decelerating rotation speed according to the weight of the laundry, thereby minimizing the deceleration time.

Turning back to FIG. 8, in response to the passage of a preset period of time from when the driving circuit 200 is controlled to decelerate the motor 141 according to the target decelerating rotation speed or in response to the rotation speed of the motor 141 reduced down to the second rotation speed in 1500, the controller 190 may control the driving circuit 200 to accelerate the motor 141 up to the final rotation speed (hereinafter, the third rotation speed) in 1600.

In this case, the third rotation speed may be set to 2 or 2.5 times the first rotation speed, and accordingly, the spin-drying efficiency may increase. For example, when the first rotation speed is 500 rpm, the third rotation speed may be 1000 rpm to 1250 rpm.

In response to the rotation speed of the motor 141 reaching the third rotation speed in 1700, the controller 190 may control the driving circuit 200 to maintain the rotation speed of the motor 141 at the third rotation speed for a preset period of time.

Subsequently, the controller 190 may decelerate the motor 141 to the fourth rotation speed in the short braking method. In this case, the fourth rotation speed may be 0 rpm. In other words, the controller 190 may stop the motor 141 in the short braking method, in 1800.

Specifically, the controller 190 may control the driving circuit 200 to decelerate the motor 141 by turning off all the upper switching circuits Q1, Q3 and Q5 and turning on all the lower switching circuits Q2, Q4 and Q6 in the second deceleration section for decelerating the motor 141 from the third rotation speed to the fourth rotation speed.

As such, in an embodiment, the washing machine 100 may promote deceleration efficiency by employing the short braking method as it is in the second deceleration section that causes no abnormal noise.

Referring to FIG. 11*a*, a spin-drying course profile of the washing machine 100 according to an embodiment may be determined. Compared with the spin-drying course speed profile in the deactivated noise reduction mode as shown in FIG. 7A, the decelerating rotation speed may be determined as being reduced in the first deceleration section. Accordingly, the time required in the first deceleration section may increase.

On the other hand, referring to FIG. 11B, it may be determined according to the spin-drying course profile of the washing machine 100 in an embodiment that the level of noise made by the motor 141 in the first deceleration section is reduced.

In an embodiment, the washing machine 100 may increase user satisfaction by minimizing an increase in spin-drying time and reducing noise occurrence in the first deceleration section.

However, referring to FIG. 12, to satisfy a requirement of the user who prefers minimization of the spin-drying time to noise occurrence, the control panel 110 of the washing machine 100 in an embodiment may provide a user interface to select activation of the noise reduction mode.

When the user activates the noise reduction mode through the control panel 110, the washing machine 100 according to an embodiment may proceed the spin-drying course according to the spin-drying course profile as shown in FIG. 11A, and when the user deactivates the noise reduction mode through the control panel 110, the washing machine 100 according to an embodiment may proceed the spin-drying course according to the spin-drying course profile as shown in FIG. 7A.

According to the embodiments, the washing machine 100 and controlling method for the washing machine 100 may satisfy requirements of the user by minimizing an increase in time required for a spin-drying course in a first deceleration section and reducing noise occurring from the motor 141.

Meanwhile, the embodiments of the disclosure may be implemented in the form of a recording medium for storing instructions to be carried out by a computer. The instructions may be stored in the form of program codes, and when executed by a processor, may generate program modules to perform operations in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In an embodiment of the disclosure, the aforementioned method according to the various embodiments of the disclosure may be provided in a computer program product. The computer program product may be a commercial product that may be traded between a seller and a buyer. The computer program product may be distributed in the form of a recording medium (e.g., a compact disc read only memory (CD-ROM)), through an application store (e.g., play Store™), directly between two user devices (e.g., smart phones), or online (e.g., downloaded or uploaded). In the case of online distribution, at least part of the computer program product (e.g., a downloadable app) may be at least temporarily stored or arbitrarily created in a recording medium that may be readable to a device such as a server of the manufacturer, a server of the application store, or a relay server.

The embodiments of the disclosure have thus far been described with reference to accompanying drawings. It will be obvious to those of ordinary skill in the art that the disclosure may be practiced in other forms than the embodiments of the disclosure as described above without changing the technical idea or essential features of the disclosure. The above embodiments of the disclosure are only by way of example, and should not be construed in a limited sense.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a rotating tub containing laundry;

a motor connected to the rotating tub;

a driving circuit configured to apply a driving current to the motor to rotate the motor;

a user interface configured to receive a user input to activate or deactivate a noise reduction mode;

a sensor configured to output a sensing value varying by a weight of the laundry; and a controller configured to control the driving circuit, based on the noise reduction mode being activated via the user interface, to apply a negative current to the motor to decelerate the motor according to a target decelerating rotation speed determined based on the weight of the laundry in response to the motor reaching a target rotation speed in a spin-drying course, control the driving circuit to rotate the motor at a final rotation speed higher than the target rotation speed for a preset period of time after the motor decelerates according to the target decelerating rotation speed, decelerate the motor in a short braking method in response to the motor reaching the final rotation speed, and control the driving circuit, based on the noise reduction mode being deactivated via the user interface, to decelerate the motor in a short braking method in response to the motor reaching the target rotation speed, wherein the controller is configured to determine the target decelerating rotation speed to be lower for a heavier weight of the laundry.

2. The washing machine of claim 1, wherein the final rotation speed is in a range from 2 to 2.5 times the target rotation speed.

3. The washing machine of claim 1, wherein the sensor comprises one of a first sensor configured to output a value of a current applied to the motor, a second sensor configured to output a value of a voltage applied to the motor, and a third sensor configured to output a value of power applied to the motor.

4. The washing machine of claim 1, wherein the controller is further configured to determine the weight of the laundry based on a sensing value output from the sensor in response to the motor reaching a preset rotation speed lower than the target rotation speed.

5. A controlling method for a washing machine including a rotating tub receiving laundry, a motor connected to the rotating tub, a driving circuit for applying a driving current to the motor to rotate the motor, a user interface configured to receive a user input to activate or deactivate a noise reduction mode; and a sensor for outputting a sensing value varying by a weight of the laundry, the controlling method comprising:

during a spin-drying course, determining the weight of the laundry;

determining a target decelerating rotation speed based on the weight of the laundry; and based on the noise reduction mode being activated via the user interface, controlling the driving circuit to apply a negative current to the motor to decelerate the motor according to the target decelerating rotation speed in response to the motor reaching a target rotation speed, controlling the driving circuit to rotate the motor at a final rotation speed higher than the target rotation speed for a preset period of time after the motor decelerates according to the target decelerating rotation speed;

decelerating the motor in a short braking method in response to the motor reaching the final rotation speed; and based on the noise reduction mode being deactivated via the user interface, controlling the driving circuit to decelerate the motor in a short braking method in response to the motor reaching the target rotation speed, wherein the determining of the target decelerating rotation speed based on the weight of the laundry comprises determining the target decelerating rotation speed to be lower for a heavier weight of the laundry.

6. The controlling method of claim 5, wherein determining the weight of the laundry comprises determining the weight of the laundry based on a sensing value output from the sensor in response to the motor reaching a preset rotation speed lower than the target rotation speed.

* * * * *